US007484320B2

(12) United States Patent
Butt et al.

(10) Patent No.: US 7,484,320 B2
(45) Date of Patent: Feb. 3, 2009

(54) FASTENING ARRANGEMENT

(75) Inventors: Phillip Butt, Helsinki (FI); Tero Pohja, Helsinki (FI)

(73) Assignee: Suunto Oy, Vantaa (FI)

( * ) Notice: Subject to any disclaimer, the term of this patent is extended or adjusted under 35 U.S.C. 154(b) by 708 days.

(21) Appl. No.: 11/070,166

(22) Filed: Mar. 3, 2005

(65) Prior Publication Data

US 2005/0224672 A1 Oct. 13, 2005

Related U.S. Application Data

(60) Provisional application No. 60/549,545, filed on Mar. 4, 2004.

(51) Int. Cl.
*A43B 23/00* (2006.01)

(52) U.S. Cl. ..... 36/136; 36/132

(58) Field of Classification Search ..... 36/132, 36/136, 137, 138
See application file for complete search history.

(56) References Cited

U.S. PATENT DOCUMENTS 4,507,882 A 4/1985 Harrell
4,630,383 A 12/1986 Gamm
4,649,552 A * 3/1987 Yukawa ..... 377/24
4,651,446 A * 3/1987 Yukawa et al. ..... 36/132
4,949,437 A 8/1990 Anderson
5,063,690 A * 11/1991 Slenker ..... 36/2.6
5,209,000 A * 5/1993 Rowland et al. ..... 36/136
5,459,947 A 10/1995 Lasher
6,122,340 A * 9/2000 Darley et al. ..... 377/24.2
6,357,147 B1 * 3/2002 Darley et al. ..... 36/136
6,817,498 B1 * 11/2004 Spratt ..... 224/191
2003/0000053 A1 1/2003 Rooney et al.
2004/0237350 A1 * 12/2004 Latham et al. ..... 36/127
2006/0010721 A1 * 1/2006 Valko ..... 36/136

FOREIGN PATENT DOCUMENTS

FR 2 798 264 A1 3/2001

* cited by examiner

*Primary Examiner*—Marie Patterson
(74) *Attorney, Agent, or Firm*—Birch, Stewart, Kolasch & Birch, LLP

(57) ABSTRACT

An attachment bracket for fastening an item to a shoe that is provided with a shoestring includes a bottom part, which can be fitted on top of the set of shoestrings, and a space for receiving the item. The attachment bracket also includes a first mounting bracket and a second mounting bracket that is spaced from the first mounting bracket. The mounting brackets can be pushed under the shoestring from opposite directions. In addition, the part of the attachment bracket between the first mounting bracket and the second mounting bracket is flexible.

11 Claims, 3 Drawing Sheets

FASTENING ARRANGEMENT

CROSS-REFERENCE TO RELATED APPLICATION

This Nonprovisional application claims priority under 35 U.S.C. § 119(e) on U.S. Provisional Application No(s). 60/549,545 filed on Mar. 4, 2004, the entire contents of which are hereby incorporated by reference.

BACKGROUND OF THE INVENTION

1. Field of the Invention

The invention relates to an attachment bracket according to the preamble of claim 1 for fastening items to a shoe that is provided with shoestrings. An attachment bracket of this type comprises a surface that can be fitted against the shoestrings and a space, in which the item can be fitted.

The invention also relates to a fastening arrangement that can be fixed to the shoe that is provided with shoestrings.

2. Description of Background Art

The functions of a human body can be measured by means of a wrist computer during sports performances or physical exercise. Typically, the wrist computer comprises a transmitter belt, which is connected to the human body by means of a flexible belt and which measures the pulse. This measuring instrument, which is provided with electrodes, transmits a measurement signal wirelessly to a wrist computer similar to a wrist watch, wherein at least part of the received signal is processed and displayed on the display of the wrist computer. In addition to the pulse, wrist computers can be used to measure blood pressure, speed, acceleration, distance, number of steps and directional data.

In measuring speed and distance, generally, a measuring device that is fastened to the shoe of the user is used, defining the trajectory of the user's foot and, based on this, also the speed of and the distance travelled by the user. The measuring device that measures the movement of the foot usually comprises an acceleration sensor, a battery, any electronics necessary for the functioning of the device, and transmitting members for a cordless transmission of the measurement data to the wrist computer. The measuring device is fitted into a casing, which is fastened to the shoe by means of a separate attachment bracket.

The publication US 2003/0000053 discloses an attachment bracket for fastening items to a shoe. The attachment bracket comprises a first member that is pushed under the shoestrings and a second member that can be fitted on top of the first member so that the shoestrings remain between the members. The item fastened to the shoe is supported on the second member or it is integral with the second member. One end of the second member is fastened pivotally to the end of the first member. The attachment bracket is installed in place so that the first member is first pushed under the shoestrings, after which the second member is swivelled on top of the shoestrings. Finally, the members are fastened to one another at the free ends thereof.

SUMMARY AND OBJECTS OF THE INVENTION

The object of this invention is to provide an improved attachment bracket for fastening items to a shoe.

The invention is based on the fact that the attachment bracket comprises a first mounting bracket and a second mounting bracket that is spaced at a distance from the first mounting bracket. The mounting brackets can be pushed under the shoestring of the shoe from the opposite directions. Furthermore, the part of the attachment bracket between the first and the second mounting brackets is flexible.

In the arrangement according to the invention, the piece that is fastened to the attachment bracket stiffens the part between the first and the second mounting brackets of the attachment bracket and, thus, prevents the attachment bracket from bending.

The invention provides considerable advantages.

The part of the attachment bracket between the first mounting bracket and the attachment point of the second mounting bracket is flexible, whereby the part of the attachment bracket between the mounting brackets can be bent, compressed and/or stretched. Therefore, the attachment bracket can be easily installed in connection with shoestrings and to detach from there. The item that is fastened to the attachment bracket stiffens the part between the attachment points of the bracket, whereby the attachment bracket remains well in place. In addition, the attachment bracket according to the invention has a simple structure and is inexpensive to manufacture.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE PREFERRED EMBODIMENTS

Figure 2:
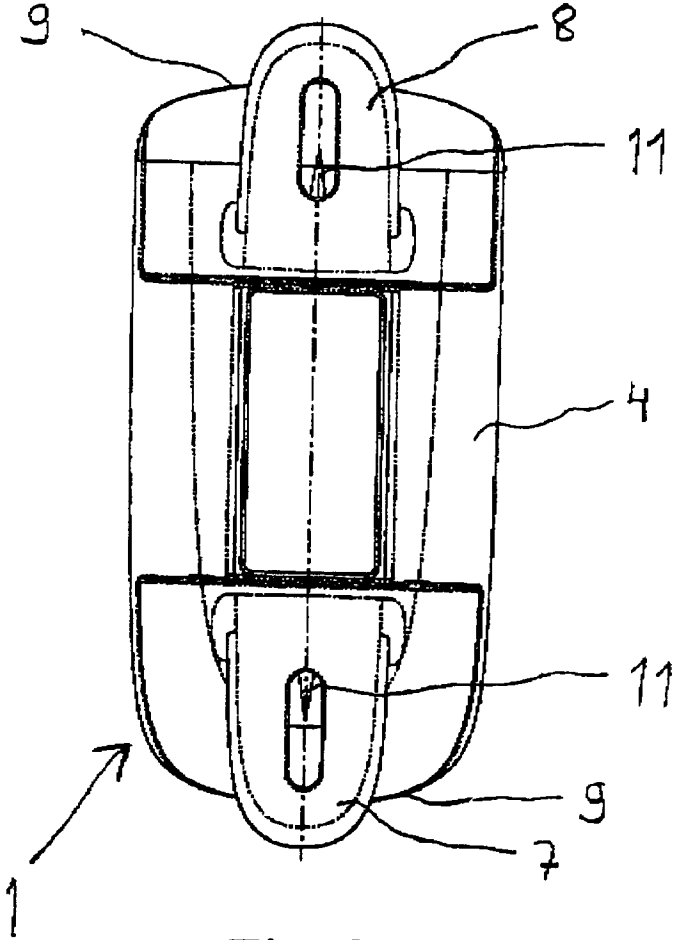
FIG. 2 shows the attachment bracket of FIG. 1 as viewed from below.
Figure 1:
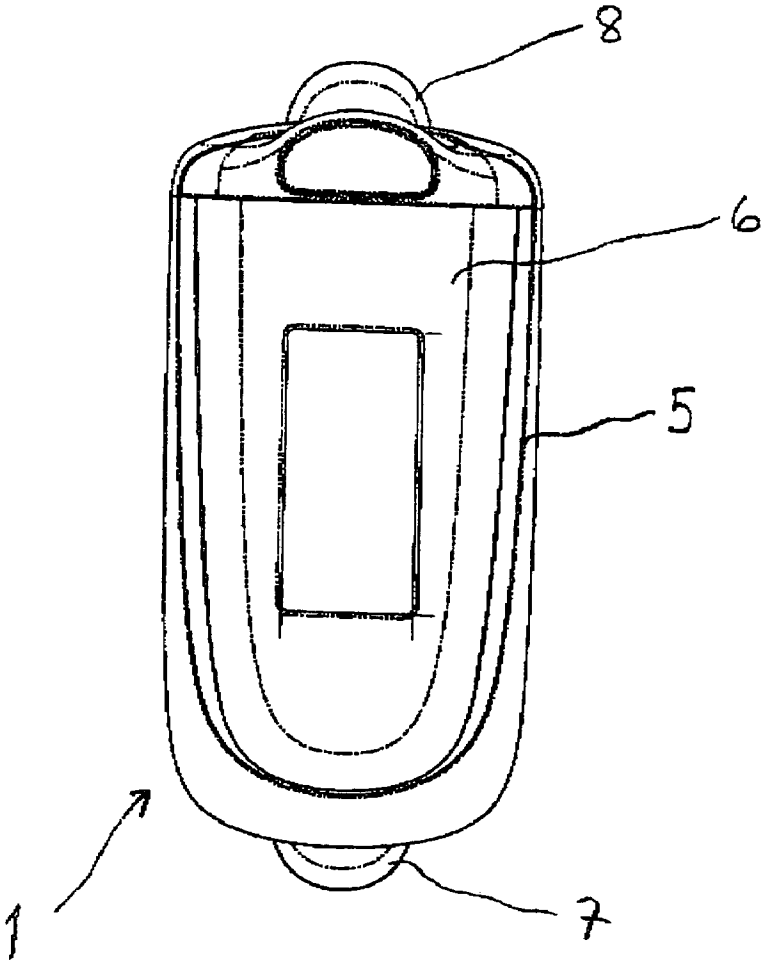
FIG. 1 shows a top view of one attachment bracket according to the invention.
Figure 4:
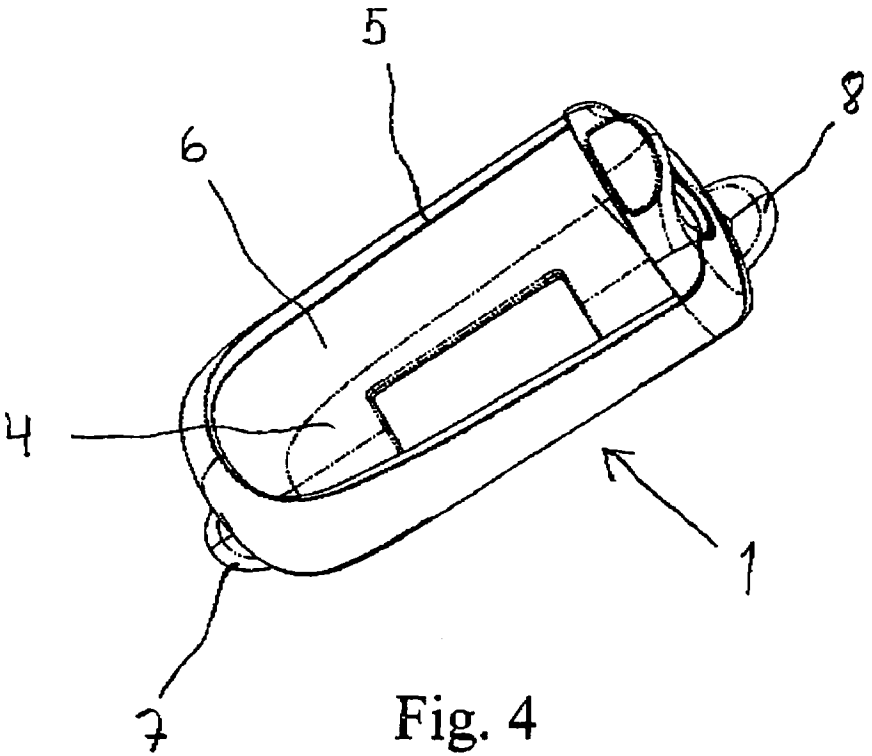
FIG. 4 shows the attachment bracket of FIG. 1 as a perspective view.
Figure 3:
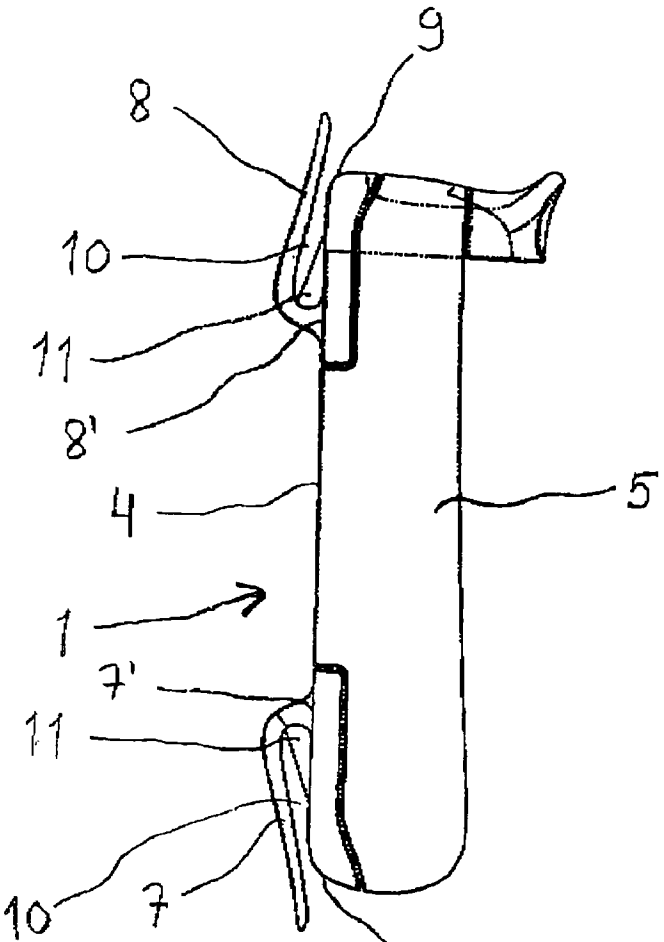
FIG. 3 shows a side view of the attachment bracket of FIG. 1.

The attachment bracket 1 according to the invention is used for fastening items 2 to a shoe 3. In one preferred embodiment of the invention, the item 2 to be fastened to the shoe 3 is a casing, in which a measuring device is inserted and used for measuring the movement of the shoe 3 of the user of the wrist computer. Typically, this type of a measuring device comprises an acceleration sensor, a battery, the electronics necessary for the functioning of the sensor and transmitter members, which are used to transmit the data about the movement of the shoe 3 cordlessly to the wrist computer on the wrist of the user, wherein the data is processed and displayed on the display of the wrist computer. Alternatively, the movement data of the shoe 3 can be transmitted from the measuring device to the wrist computer via a data-transmission cord placed between them, or the movement data can be processed in the measuring device fastened to the shoe 3 and displayed on the display in the measuring device.

The attachment bracket shown in the drawings comprises a bottom part 4 that can be fitted against the shoestring 12 of the shoe 3, and rims 5 that surround the bottom part 4. A trough-like space 6 is formed inside the rims, into which space the item to be fastened to the shoe 3 can be fitted. The space 6 is shaped so that it conforms to the configuration of the item fitted into it. The rims 5 are shaped so that their edges slightly curve towards the middle of the space 6, whereby they keep the item 2 in place in the space 6.

A first mounting bracket 7 is fastened to the bottom part and a second mounting bracket 8 is fastened at a distance from there. The mounting brackets 7, 8 are fastened to a surface of the bottom part 4 that is fitted against the set of shoestrings. The attachment points of the mounting brackets 7, 8 to the bottom part 4 are spaced from the ends 9 of the bottom part 4. Typically, the distance of each attachment point 7', 8' from the end 9 of the bottom part 4 is about 15 mm. The mounting brackets 7, 8, at their attachment points 7', 8', extend away from one another towards the ends 9 of the bottom part 4. In addition, the mounting brackets 7, 8 extend in opposite directions from their attachment points 7', 8'. The free ends of the mounting brackets 8, 9| extend approximately to the level of the ends 9 of the bottom part or slightly over the ends 9. Between the mounting brackets 7, 8 and the bottom part 4, there is provided a gap 10, into which the shoestring can be fitted. The bottom of the gap 10 is provided with a projection 11 that extends away from the bottom part and keeps the shoestring in place in the gap 10.

Figure 5B:
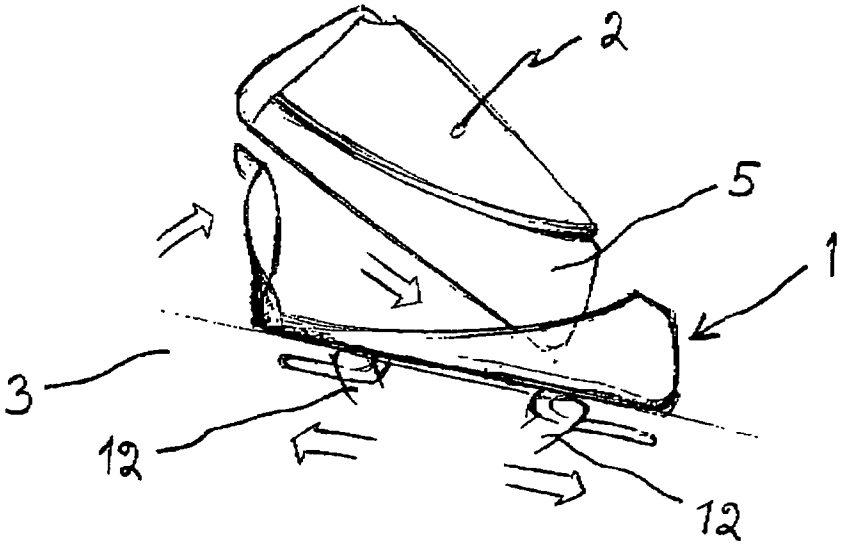
FIGS. 5*a*-5*c* show one fastening arrangement according to the invention being fastened to a shoe.
Figure 5A:
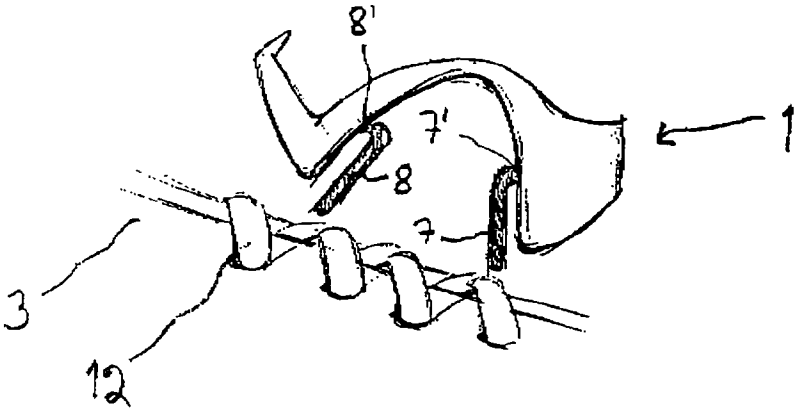
Figure 5C:
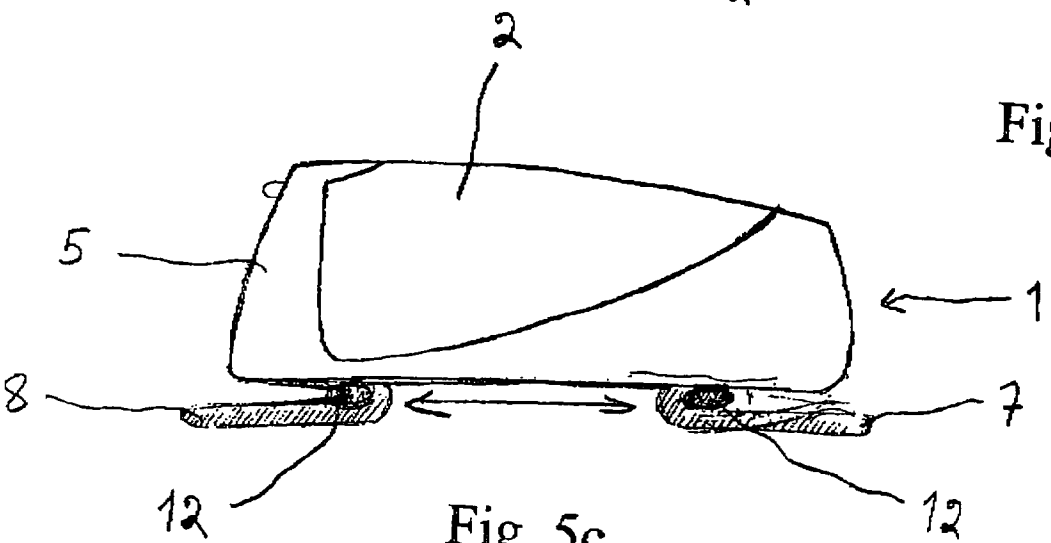

At least the part of the attachment bracket 1 that remains between the attachment points 7', 8' of the mounting brackets 7, 8 is made of flexible material. In that case, the part between the attachment points 7', 8' can be swept so that the free ends of the mounting brackets 7, 8 become closer to one another (FIG. 5*a*). The other parts of the bottom part 4 and the rims 5 are preferably also made of flexible material. In order to be able to change the width of the gap 10 between the mounting brackets 7, 8 and the bottom part 4 by bending the mounting brackets 7, 8, the mounting brackets 7, 8 are also made of flexible material. The bottom 4, the rims 5 and the mounting brackets 7, 8 are preferably made of plastic. A suitable stiffness for the different parts of the attachment bracket 1 must be defined on the basis of experiments.

The attachment bracket 1 is fastened to the shoe 3 that is on the user's foot, when the shoestring 12 is tensioned and tied up. The part between the mounting brackets 7, 8 of the attachment bracket 1 is first bent so that the free ends of the mounting brackets 7, 8 become closer to one another in accordance with FIG. 5*a*. In that case, the mounting brackets 7, 8 are inside a curve. After this, the free ends of the mounting brackets 7, 8 are pushed under the shoestring 12 so that the shoestring 12 is between the mounting bracket 7, 8 and the bottom part 4. The mounting brackets 7, 8 can be pushed under the shoestring 12 simultaneously, while the attachment bracket 1 is bent. Alternatively, the first mounting bracket 7 can be pushed under the shoestring 12 first, after which the attachment bracket 1 is bent and the second mounting bracket 8 is pushed under the shoestring 12. The mounting brackets 7, 8 are pushed under the shoestring 12 from opposite directions.

The bending of the attachment bracket 1 is ended, when the mounting brackets 7, 8 are under the shoestring 12, whereby the attachment bracket 1 straightens out and resumes its original shape. At the same time, the shoestring 12 projects into the bottom of the gap 10 between the bottom part 4 and the mounting bracket 7, 8 (FIG. 5*b*). After this, the item 2 is fitted in place in the space 6 inside the rims 5 of the attachment bracket 1. The rims 5 of the attachment bracket 1 yield, when the item 2 is fitted into the space 6. Alternatively, or in addition to this, the bottom part 4 of the attachment bracket 1 can be slightly swept between the attachment points 7', 8' of the mounting brackets 7, 8, when the item 2 is fitted in place in the space 6. In that case, the bottom part 4 bends in the same direction as in FIG. 5*a,* i.e., the mounting brackets 7, 8 are within the curve. The inwardly curved upper parts of the rims on the sides and/or at the ends of the bottom part 4 keep the item 2 in place in the space 6 when the item 2 is fitted into the space 6.

The distance between the points, wherein the mounting brackets 7, 8 are pushed under the shoestrings 12, is preferably shorter than that between the attachment points 7', 8' of the bottom part 4 of the mounting brackets 7, 8, when the attachment bracket 1 is in its unbent state. In that case, the shoestring 12 is more effective in keeping the attachment bracket 1 in place.

The item 2 that is fitted into the space 6 is inflexible. When in its place in the space 6, the item 2 stiffens the attachment bracket 1, whereby the part of the attachment bracket 1 between the attachment points 7', 8' of the mounting brackets 7, 8 cannot be bent. In this way, the attachment bracket 1 remains attached to the shoe 3. The attachment bracket 1 is detached from the shoe 3 in a reverse order with respect to the above. First, the item 2 is removed from the space 6, after which the attachment bracket 1 is bent and the mounting brackets 7, 8 are removed from under the shoestring 1|.

The invention has embodiments that deviate from the above. For example, there may be two or more mounting brackets 7, 8 that are fastened to the bottom part, side by side in the vicinity of each end of the bottom part.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An attachment bracket for fastening an item to a shoe that is provided with a shoestring, the attachment bracket comprising a bottom part adapted to be fitted on top of a set of shoestrings, and a space adapted to receive the item, wherein the attachment bracket further comprises a first mounting bracket and a second mounting bracket that is spaced from the first mounting bracket, said mounting brackets being adapted to be pushed under the shoestring from opposite directions, and when the attachment bracket is viewed in a bottom view, the first and the second mounting brackets are seen to extend parallel to a long dimension of the attachment bracket, and the part of the attachment bracket between the first mounting bracket and the second mounting bracket is flexible, and when the flexible part of the attachment bracket is flexed, the free ends of the mounting brackets are moved closer to one another.

2. An attachment bracket according to claim 1, wherein the first and second mounting brackets extend away from one another.

3. An attachment bracket according to claim 1, wherein the first and the second mounting brackets extend in opposite directions.

4. An attachment bracket according to claim 1, wherein when the flexible part of the attachment bracket is flexed, both of the mounting brackets are capable pushed under the shoestring so that the shoestring is between the mounting bracket and the bottom part.

5. An attachment bracket according to claim 1, wherein the part of the attachment bracket between the first mounting and the second mounting bracket is bendable, compressable, and/or stretchable.

6. An attachment bracket according to claim 1, wherein the first and the second mounting brackets are disposed on the bottom part, the space of the attachment bracket being adapted to receive the item on a side of the attachment bracket opposite with respect to the bottom part.

7. An attachment bracket according to claim 1, wherein the space is a through-shaped space surrounded by rims of the attachment bracket, and when the flexible part of the attachment bracket is flexed in order to move the free ends of the mounting brackets closer to one another, a portion of the rims between the first and second mounting brackets is adapted to move into a convex shape.

8. An arrangement adapted to be fastened to a shoe that is provided with a shoestring, the arrangement including an attachment bracket and an item, wherein the attachment bracket is adapted to fasten the item to the shoe that is provided with the shoestring, the attachment bracket comprising a bottom part adapted to be fitted on top of a set of shoestrings, and a space adapted to receive the item, the attachment bracket further comprising a first mounting bracket and a second mounting bracket that is spaced from the first mounting bracket, said mounting brackets being adapted to be pushed under the shoestring from opposite directions, and when the attachment bracket is viewed in a bottom view, the first and the second mounting brackets are seen to extend parallel to a long dimension of the attachment bracket, and the part of the attachment bracket between the first mounting bracket and the second mounting bracket is flexible, and when the flexible part of the attachment bracket is flexed, the free ends of the mounting brackets are moved closer to one another, and wherein the item is adapted to stiffen the flexible part between the first mounting bracket and the second mounting bracket of the attachment bracket, and being adapted to be fitted into the space.

9. An arrangement according to claim 8, wherein the item that stiffens the part between the first mounting bracket (7) bracket and the second mounting bracket is a casing that contains an acceleration sensor measuring the movement of the shoe.

10. An arrangement according to claim 8, wherein the first and the second mounting brackets are disposed on the bottom part, the space of the attachment bracket being adapted to receive the item on a side of the attachment bracket opposite with respect to the bottom part.

11. An arrangement according to claim 8, wherein the space is a through-shaped space surrounded by rims of the attachment bracket, and when the flexible part of the attachment bracket is flexed in order to move the free ends of the mounting brackets closer to one another, a portion of the rims between the first and second mounting brackets is adapted to move into a convex shape.

* * * * *